US009752351B2

(12) United States Patent
Yang et al.

(10) Patent No.: US 9,752,351 B2
(45) Date of Patent: Sep. 5, 2017

(54) ENVIRONMENT FRIENDLY METAL MECHANICAL PASSWORD LOCK CYLINDER CAPABLE OF SETTING REPEATED PASSWORD KEYS

(71) Applicant: Dongguan Suoan Industrial Co., Ltd., Guangdong Province (CN)

(72) Inventors: Fenghao Yang, Dongguan (CN); Qingbo Tu, Dongguan (CN)

(73) Assignee: SHENZHEN DEMIKA ELECTRONIC TECHNOLOGY CO., LTD. (CN)

( * ) Notice: Subject to any disclaimer, the term of this patent is extended or adjusted under 35 U.S.C. 154(b) by 0 days.

(21) Appl. No.: 14/854,360

(22) Filed: Sep. 15, 2015

(65) Prior Publication Data

US 2016/0002952 A1 Jan. 7, 2016

Related U.S. Application Data

(63) Continuation-in-part of application No. 14/149,014, filed on Jan. 7, 2014, now abandoned.

(51) Int. Cl.
*E05B 37/00* (2006.01)
*E05B 37/16* (2006.01)

(52) U.S. Cl.
CPC ..... *E05B 37/0048* (2013.01); *E05B 37/16* (2013.01); *Y10T 70/7322* (2015.04)

(58) Field of Classification Search
CPC ..... E05B 37/16; E05B 37/163; E05B 37/103; E05B 37/00; E05B 65/0014; E05B 37/12; E05B 65/464; Y10T 70/7068; Y10T 70/417
USPC ..... 70/214, 287, 288, 297–299, 315
See application file for complete search history.

(56) References Cited

U.S. PATENT DOCUMENTS 1,430,332 A * 9/1922 Smith ..... E05B 37/16 70/149
1,871,303 A * 8/1932 Chesick ..... E05B 37/16 70/284
2,162,995 A * 6/1939 Bruington ..... E05B 37/163 200/40
2,494,015 A * 1/1950 Tate ..... H01H 27/10 200/43.12

(Continued)

FOREIGN PATENT DOCUMENTS

GB 2180587 A * 4/1987 ..... E05B 37/16

*Primary Examiner* — Suzanne Barrett

(57) ABSTRACT

An environment friendly metal mechanical password lock cylinder capable of setting repeatedly password keys comprises password rebound leaves, a label panel, a fastener locking plate, a positioning plate, a fastener reset plate, an axis panel and a control plate. The label panel is fixedly connected with the positioning plate; the fastener locking plate is disposed between the label panel and the positioning plate; the fastener reset plate is slideably disposed on the positioning plate; the axis panel is matched and connected with the label panel; the control plate is slideably disposed on the axis panel; the password rebound leaf runs through the label panel and the positioning plate in sequence and corresponds to the control plate; the number of the password rebound leaves is set to be several; and at least one password rebound leaf in the plurality of password rebound leaves is provided with positioning blocks matched with the control plate.

9 Claims, 9 Drawing Sheets

(56) References Cited

U.S. PATENT DOCUMENTS

| | | | | | |
|---|---|---|---|---|---|
| 3,009,346 | A * | 11/1961 | Check | E05B 37/16 | 70/150 |
| 3,187,528 | A * | 6/1965 | Check | E05B 37/16 | 70/288 |
| 3,910,078 | A * | 10/1975 | Schulz | E05B 37/16 | 292/264 |
| 4,660,394 | A * | 4/1987 | Wu | B60R 25/0221 | 70/238 |
| 4,748,833 | A * | 6/1988 | Nagasawa | E05B 37/16 | 70/214 |
| 6,334,346 | B1 * | 1/2002 | Wang | E05B 37/16 | 70/214 |
| 6,487,803 | B1 * | 12/2002 | Yu | F41A 17/54 | 42/70.07 |
| 6,837,080 | B2 * | 1/2005 | Lee | E05B 37/16 | 70/214 |
| 7,043,948 | B1 * | 5/2006 | Wang | E05B 37/16 | 70/214 |
| 8,347,673 | B2 * | 1/2013 | Wang | E05B 37/16 | 70/214 |
| 8,375,751 | B2 * | 2/2013 | Hacker | E05B 19/0005 | 292/DIG. 27 |
| 2005/0210937 | A1 * | 9/2005 | Okuda | E05B 37/16 | 70/214 |
| 2008/0115546 | A1 * | 5/2008 | Hu | E05B 13/004 | 70/214 |
| 2012/0324970 | A1 * | 12/2012 | Watanabe | E05B 37/16 | 70/315 |
| 2015/0000355 | A1 * | 1/2015 | Wong | E05B 37/166 | 70/291 |

* cited by examiner

ENVIRONMENT FRIENDLY METAL MECHANICAL PASSWORD LOCK CYLINDER CAPABLE OF SETTING REPEATED PASSWORD KEYS

CROSS-REFERENCE TO RELATED APPLICATION

This application is a continuation-in-part of U.S. application Ser. No. 14/149,014 filed on Jan. 7, 2014.

FIELD OF THE INVENTION

The present invention belongs to the technical field of combination locks, in particular to an environment friendly metal mechanical password lock cylinder capable of setting repeatedly password keys.

BACKGROUND OF THE INVENTION

In the prior art, the combination lock generally has two means, namely electronic combination lock and mechanical combination lock. As the electronic combination lock requires power supply and has the defect that passwords can be scanned and deciphered, the application of the electronic combination lock is greatly limited.

Along with social progress, the combination locks are more and more widely applied but the problem of the combination locks being deciphered is also more and more severe. As password keys of combination locks in the current market can only be used for setting non-repeated passwords, the password combinations of the combination locks are few, and hence the deciphering difficulty is low.

Therefore, an environment friendly metal mechanical password lock cylinder capable of setting repeatedly password keys is required to be provided to solve the above technical problems.

SUMMARY OF THE INVENTION

The objective of the present invention is that: an environment friendly metal mechanical password lock cylinder capable of setting repeatedly password keys is provided to overcome the defects in the prior art, in which password sequence keys of the lock cylinder can be repeatedly set for a plurality of times, so that the number of password combinations of the combination lock can be increased, and hence the safety of the mechanical combination lock can be improved.

In order to achieve the above objective, the present invention adopts the following technical proposal:

the present invention relates to an environment friendly metal mechanical password lock cylinder capable of setting repeatedly password keys, which comprises password rebound leaves, a label panel, a fastener locking plate, a positioning plate, a fastener reset plate, an axis panel and a control plate, wherein the label panel is fixedly connected with the positioning plate; the fastener locking plate is disposed between the label panel and the positioning plate; the fastener reset plate is slideably disposed on the positioning plate; the axis panel is matched and connected with the label panel; the control plate is slideably disposed on the axis panel; the password rebound leaf runs through the label panel and the positioning plate in sequence and corresponds to the control plate; the number of the password rebound leaves is set to be several; and at least one password rebound leaf in the plurality of password rebound leaves is provided with positioning blocks matched with the control plate.

As an improvement of the environment friendly metal mechanical password lock cylinder capable of setting repeatedly the password keys, provided by the present invention, the password rebound leaves include a No. A password rebound leaf, a No. B password rebound leaf, a No. C password rebound leaf, a No. D password rebound leaf and No. 0 password rebound leaves; each of the No. A password rebound leaf, the No. B password rebound leaf, the No. C password rebound leaf, the No. D password rebound leaf and the No. 0 password rebound leaves includes a password rebound leaf body, grooves disposed on the top of the password rebound leaf body, a push reset portion disposed on a side portion of the password rebound leaf body, and a "Z"-shaped button spring access hole disposed in the center of the password rebound leaf body; the grooves include a first groove, a second groove and a third groove which are disposed on the password rebound leaf body in sequence; a button spring is mounted in the "Z"-shaped button spring access hole; the push reset portion includes a reset plane, a push portion and a limit point which are connected with each other in sequence; the included angle between the horizontal plane and the push portions of the No. A password rebound leaf, the No. B password rebound leaf, the No. C password rebound leaf and the No. D password rebound leaf is 20 to 70 degrees; the push portion and the limit point of the No. D password rebound leaf form a plane structure; and the push reset portion of the No. 0 password rebound leaf only includes a reset plane.

As an improvement of the environment friendly metal mechanical password lock cylinder capable of setting repeatedly the password keys, provided by the present invention, the No. A password rebound leaf, the No. B password rebound leaf, the No. C password rebound leaf or the No. D password rebound leaf is provided with 1 to 4 positioning blocks; and when the number of the positioning blocks is more than two, the positioning blocks are alternately arranged.

As an improvement of the environment friendly metal mechanical password lock cylinder capable of setting repeatedly the password keys, provided by the present invention, the label panel includes a panel body, an axis hole disposed in the center of the panel body, a plurality of first password rebound leaf relief grooves uniformly distributed on the panel body, and an edge groove disposed at the edge of the panel body; a shaft housing is mounted in the axis hole; the axis panel is connected with an axis; and the axis runs through the fastener reset plate, the positioning plate and the fastener locking plate in sequence and is matched and connected with the shaft housing.

As an improvement of the environment friendly metal mechanical password lock cylinder capable of setting repeatedly the password keys, provided by the present invention, the fastener locking plate includes a fastener locking plate body, first stop grooves disposed at the edge of both sides of the fastener locking plate respectively, a return spring gear piece disposed on the fastener locking plate body, a bottom plate limit piece and first panel limit pieces disposed on the top of the fastener locking plate body respectively, password exchange buttons disposed at the bottom of the fastener locking plate body, an axis relief hole disposed in the center of the fastener locking plate body, and password rebound leaf spring relief holes distributed on both sides of the axis relief hole.

As an improvement of the environment friendly metal mechanical password lock cylinder capable of setting repeatedly the password keys, provided by the present invention, the positioning plate includes a positioning plate body, second panel limit pieces integrally connected with the positioning plate body, a shaft housing rivet hole disposed in the center of the positioning plate body, guide post relief holes disposed on both sides of the shaft housing rivet hole, and second password rebound leaf relief grooves distributed on the positioning plate body; the second panel limit piece is provided with a fastener locking plate stroke groove; the fastener reset plate includes a fastener reset plate body, second stop grooves disposed at the edge of both sides of the fastener reset plate body respectively, a reset piece disposed at the bottom of the fastener reset plate body, a driving stroke relief hole disposed in the center of the fastener reset plate body, and stop piece stroke holes distributed on both sides of the driving stroke relief hole; the positioning plate is connected with bottom plate tension spring screws; and the fastener reset plate is connected with a stop piece tension spring screw which is connected with the bottom plate tension spring screw through a tension spring.

As an improvement of the environment friendly metal mechanical password lock cylinder capable of setting repeatedly the password keys, provided by the present invention, the axis panel includes an axis panel body, axis panel tension spring fixing portions disposed on both sides of the top of the axis panel body, an axis panel adjusting device disposed between the axis panel tension spring fixing portions, guide post holes disposed in the center of the axis panel body, a plurality of axis panel drive grooves distributed on both sides of the guide post holes, and a control plate limit stand disposed on the axis panel body; the axis panel tension spring fixing portion is provided with a tension spring fixing groove; the axis panel adjusting device includes an adjusting fixing plate, a screw hole disposed on the adjusting fixing plate, and an adjusting nut mounted in the screw hole; the control plate limit stands include strip control plate limit stands disposed on both sides of the guide post holes and a "U"-shaped control plate limit stand disposed at the edge of the axis panel body; and guide rods are mounted in the guide post holes.

As an improvement of the environment friendly metal mechanical password lock cylinder capable of setting repeatedly the password keys, provided by the present invention, the control plate includes a control plate body, control plate stroke grooves and control plate tension spring grooves disposed on both sides of the control plate body, a control plate bolt disposed at the bottom of the control plate body, password rebound leaf stroke grooves disposed in the center of the control plate body, and control plate stroke rivet holes disposed on both sides of the password rebound leaf stroke grooves; and the control plate tension spring grooves are connected with the tension spring fixing grooves through control plate tension springs.

As an improvement of the environment friendly metal mechanical password lock cylinder capable of setting repeatedly the password keys, provided by the present invention, the lock cylinder further comprises a stop piece return spring, wherein the stop piece return spring is sleeved on a riveting column which is configured to fixedly connect the label panel and the positioning plate; one end of the stop piece return spring leans against the return spring gear piece; and the other end of the stop piece return spring leans against the second panel limit piece.

As an improvement of the environment friendly metal mechanical password lock cylinder capable of setting repeatedly the password keys, provided by the present invention, the lock cylinder further comprises a driving spring, wherein the driving spring is sleeved on the axis; one end of the driving spring leans against the label panel; and the other end of the driving spring leans against the positioning plate.

The lock cylinder provided by the present invention has the advantages that: the lock cylinder provided by the present invention comprises password rebound leaves, a label panel, a fastener locking plate, a positioning plate, a fastener reset plate, an axis panel and a control plate. The label panel is fixedly connected with the positioning plate; the fastener locking plate is disposed between the label panel and the positioning plate; the fastener reset plate is slideably disposed on the positioning plate; the axis panel is matched and connected with the label panel; the control plate is slideably disposed on the axis panel; the password rebound leaf runs through the label panel and the positioning plate in sequence and corresponds to the control plate; the number of the password rebound leaves is set to be several; and at least one password rebound leaf in the plurality of password rebound leaves is provided with positioning blocks matched with the control plate. By adoption of the positioning blocks disposed on the password rebound leaves in the lock cylinder provided by the present invention, the password rebound leaves and the control plate can be subjected to positioning and clamping for two times. That is to say, in the case of password setting of the password rebound leaves, the repeated setting of two or more than two times can be achieved. Therefore, the number of combinations of password setting in the lock cylinder is increased, and hence the safety of the lock cylinder provided by the present invention can be improved. The lock cylinder provided by the present invention can be widely applied in the fields of door locks, safe locks, cabinet locks, car locks, etc.

DETAILED DESCRIPTIONS OF THE PREFERRED EMBODIMENTS

Figure 1:
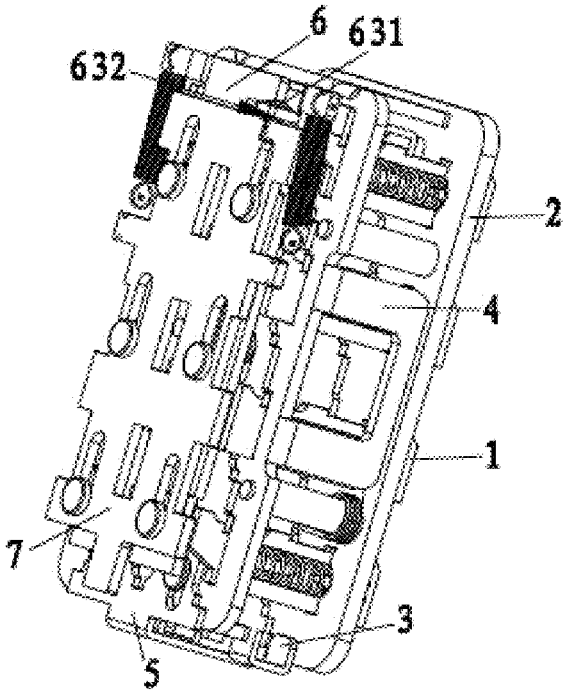
FIG. 1 is a schematic structural view of a lock cylinder provided by the present invention.
Figure 2:
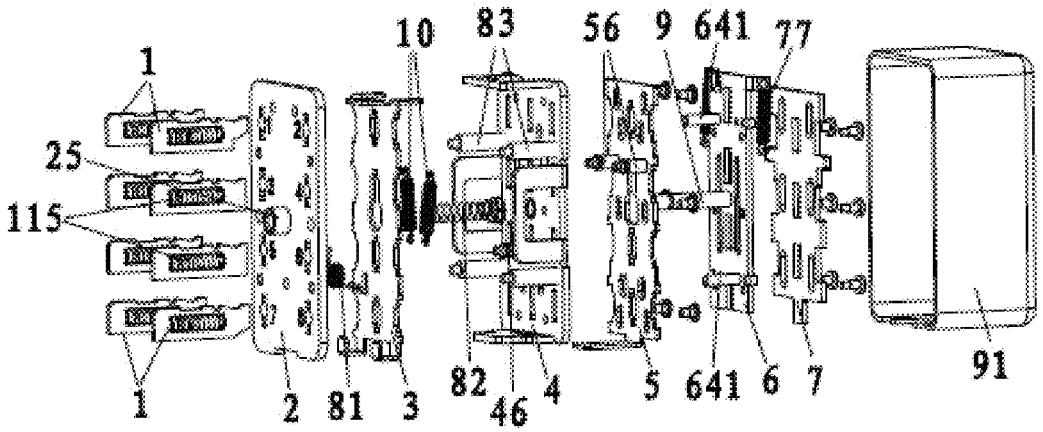
FIG. 2 is a schematic exploded view of the lock cylinder provided by the present invention.
Figure 3:
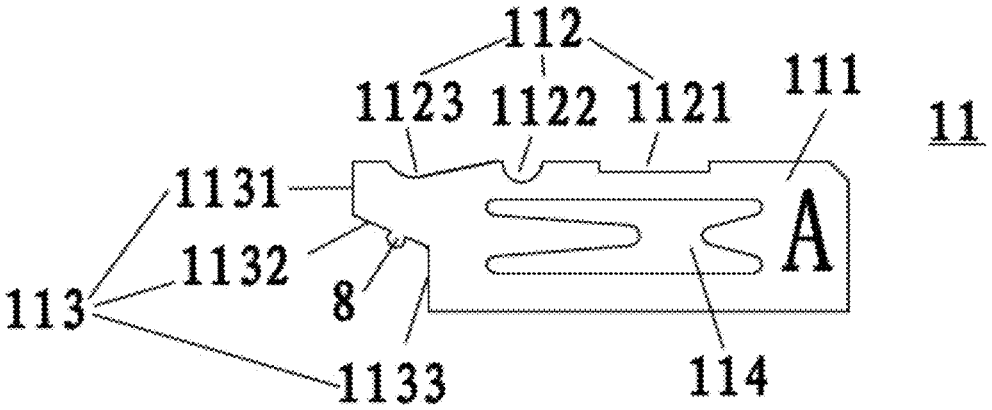
FIG. 3 is a schematic structural view of a No. A password rebound leaf in the lock cylinder provided by the present invention.
Figure 4:
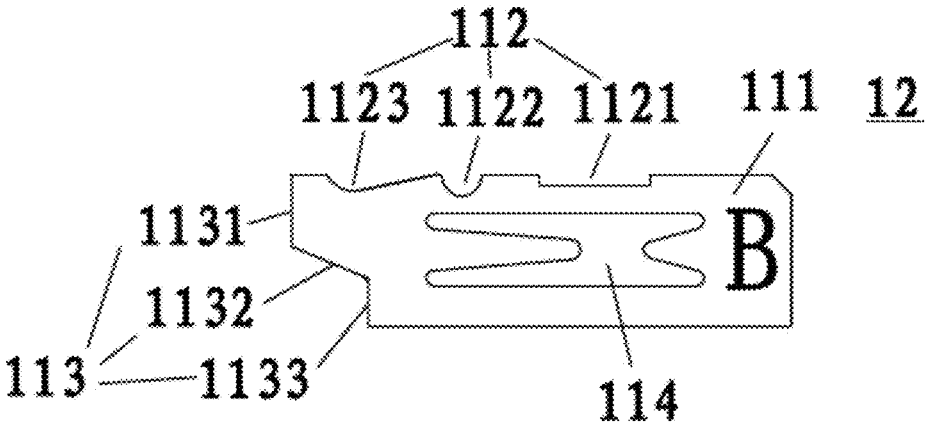
FIG. 4 is a schematic structural view of a No. B password rebound leaf in the lock cylinder provided by the present invention.
Figure 5:
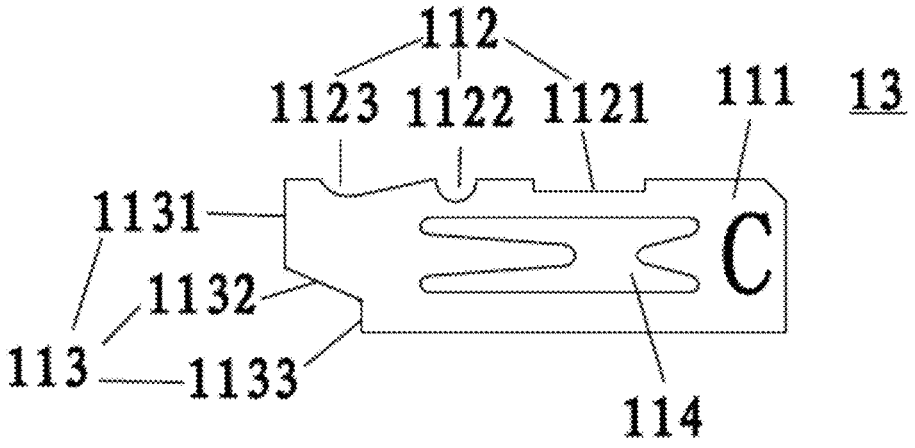
FIG. 5 is a schematic structural view of a No. C password rebound leaf in the lock cylinder provided by the present invention.
Figure 6:
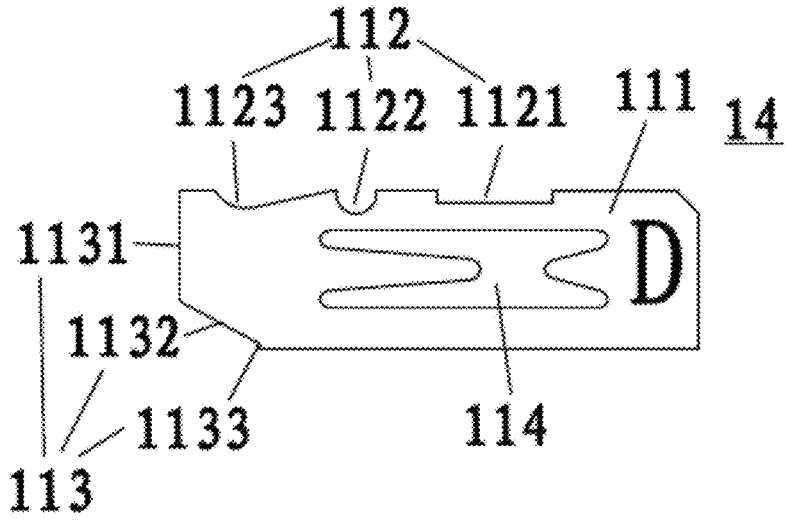
FIG. 6 is a schematic structural view of a No. D password rebound leaf in the lock cylinder provided by the present invention.
Figure 7:
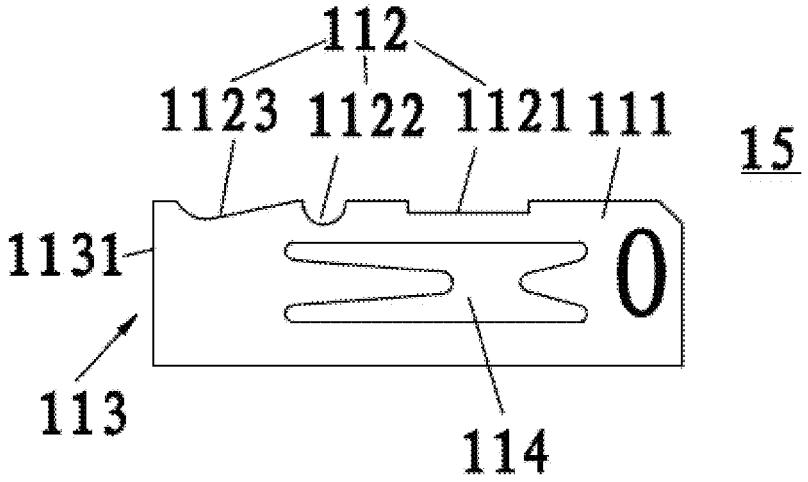
FIG. 7 is a schematic structural view of a No. 0 password rebound leaf in the lock cylinder provided by the present invention.
Figure 8:
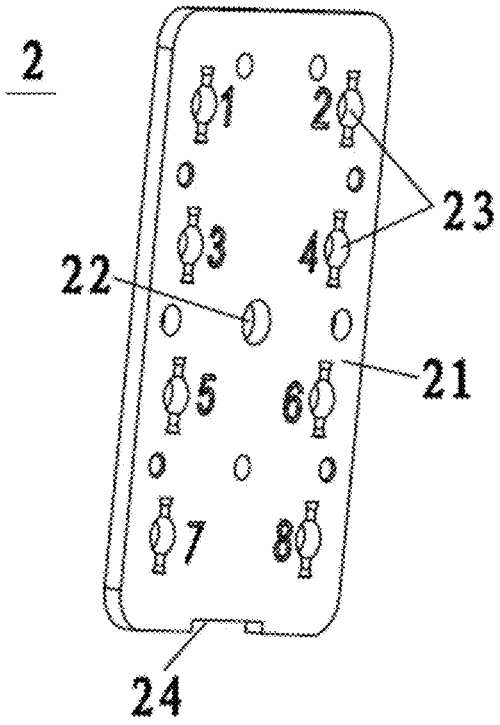
FIG. 8 is a schematic structural view of a label panel in the lock cylinder provided by the present invention.
Figure 9:
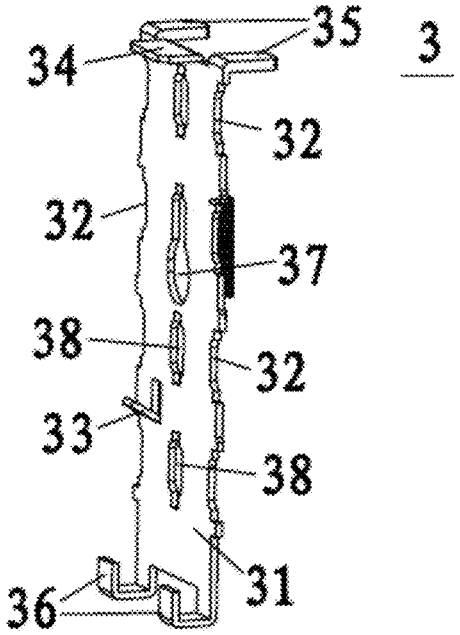
FIG. 9 is a schematic structural view of a fastener locking plate in the lock cylinder provided by the present invention.
Figure 10:
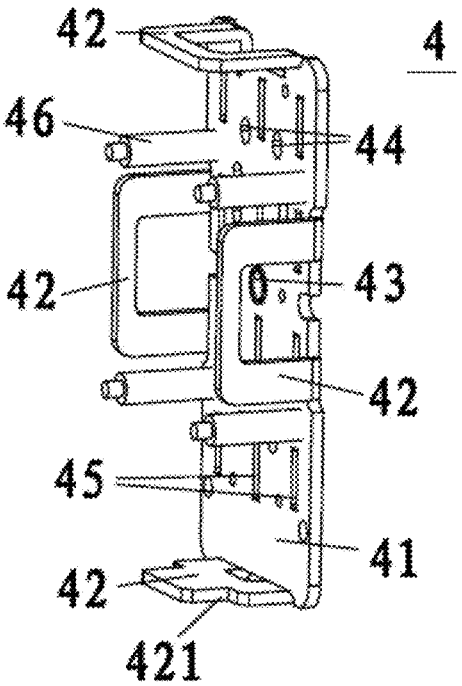
FIG. 10 is a schematic structural view of a positioning plate in the lock cylinder provided by the present invention.
Figure 11:
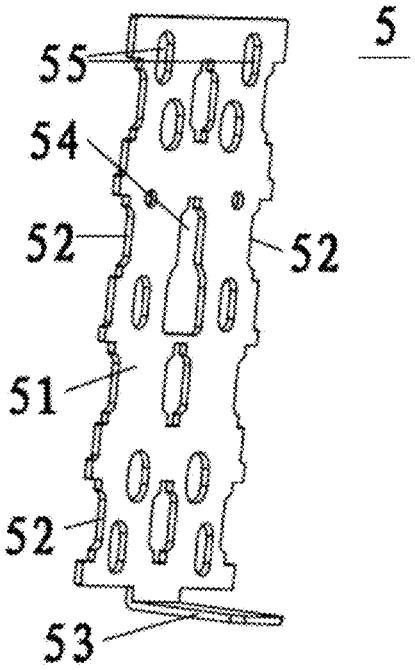
FIG. 11 is a schematic structural view of a fastener reset plate in the lock cylinder provided by the present invention.
Figure 12:
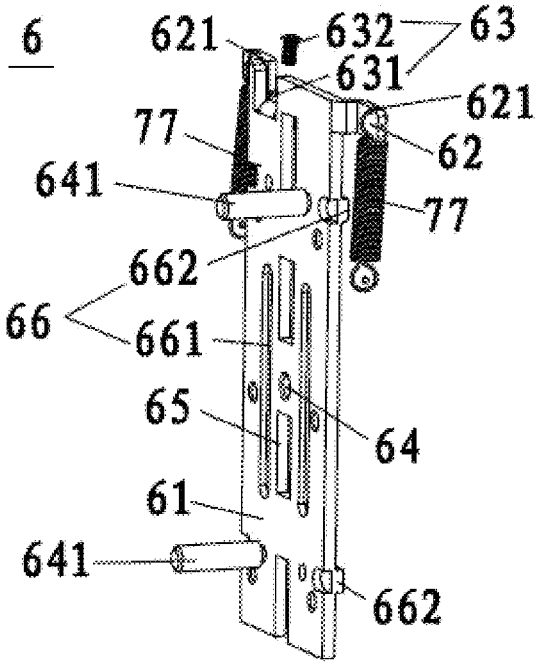
FIG. 12 is a schematic structural view of an axis panel in the lock cylinder provided by the present invention.
Figure 13:
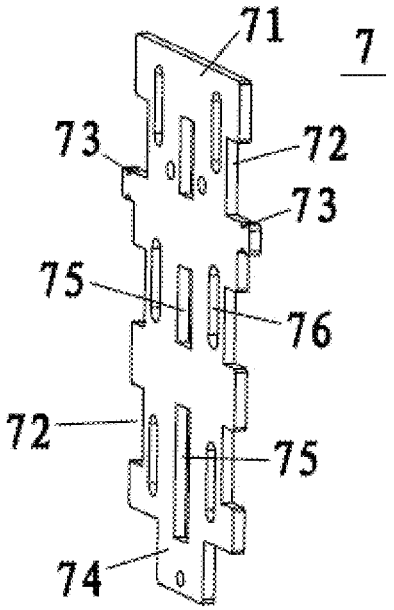
FIG. 13 is a schematic structural view of a control plate in the lock cylinder provided by the present invention.

Further detailed description will be given below to the present invention with reference to the preferred embodiments and the accompanying drawings, but the embodiments of the present invention are not limited thereto.

As illustrated in FIGS. 1 to 13, the invention discloses an environment friendly metal mechanical password lock cylinder capable of setting repeatedly password keys, which comprises password rebound leaves 1, a label pane 2, a fastener locking plate 3, a positioning plate 4, a fastener reset plate 5, an axis panel 6 and a control plate 7. The label panel 2 is fixedly connected with the positioning plate 4; the fastener locking plate 3 is disposed between the label panel 2 and the positioning plate 4; the fastener reset plate 5 is slideably disposed on the positioning plate 4; the axis panel 6 is matched and connected with the label panel 2; the control plate 7 is slideably disposed on the axis panel 6; the password rebound leaf 1 runs through the label panel 2 and the positioning plate 4 in sequence and corresponds to the control plate 7; the number of the password rebound leaves 1 is set to be several; and at least one password rebound leaf 1 in the plurality of password rebound leaves 1 is provided with positioning blocks 8 matched with the control plate 7. By arrangement of the positioning blocks 8, the password rebound leaves 1 and the control plate 7 can be subjected to positioning and clamping for a plurality of times, so that the lock cylinder provided by the present invention can achieve repeated password setting. That is to say, the password rebound leaf 1 provided with one positioning block 8 can achieve repeated setting for one time, and the password rebound leaf 1 provided with two positioning blocks 8 can achieve repeated setting for two times. In addition, the lock cylinder provided by the present invention is also sleeved with an outer shell 91 which has the protective function and is conducive to future installation. It is important that the lock cylinder and the outer shell 91 adopt an all-metal mechanical structure, are durable and do not require the supply of any power supply, so that the objectives of energy saving and environmental protection can be achieved.

Preferably, the password rebound leaves 1 include a No. A password rebound leaf 11, a No. B password rebound leaf 12, a No. C password rebound leaf 13, a No. D password rebound leaf 14 and No. 0 password rebound leaves 15; each of the No. A password rebound leaf 11, the No. B password rebound leaf 12, the No. C password rebound leaf 13, the No. D password rebound leaf 14 and the No. 0 password rebound leaf 15 includes a password rebound leaf body 111, grooves 112 disposed on the top of the password rebound leaf body 111, a push reset portion 113 disposed on a side portion of the password rebound leaf body 111, and a "Z"-shaped button spring access hole 114 disposed in the center of the password rebound leaf body 111; the grooves 112 include a first groove 1121, a second groove 1122 and a third groove 1123 which are disposed on the password rebound leaf body 111 in sequence; a button spring 115 is mounted in the "Z"-shaped button spring access hole 114; when the password rebound leaf 1 is horizontally pushed, the button spring 115 supports the positioning plate 4; in the case of reset, the password rebound leaf 1 is restored to the original position under the action of the button spring 115; the push reset portion 113 includes a reset plane 1131, a push portion 1132 and a limit point 1133 which are connected with each other in sequence, so that the push reset portion 113 can be better matched with the control plate 7.

The included angle between a horizontal plane and the push portions 1132 of the No. A password rebound leaf 11, the No. B password rebound leaf 12, the No. C password rebound leaf 13 and the No. D password rebound leaf 14 is 20 to 70 degrees. In the embodiment, the included angle between the push portion 1132 of the No. A password rebound leaf 11 and the horizontal plane is set to be 22.86°, so that the slide stroke of slide-down of the control plate 7 is 1.56 mm; the included angle between the push portion 1132 of the No. B password rebound leaf 12 and the horizontal plane is set to be 22.73°, so that the slide stroke of slide-down of the control plate 7 is 1.55 mm; the included angle between the push portion 1132 of the No. C password rebound leaf 13 and the horizontal plane is set to be 23.12°, so that the slide stroke of slide-down of the control plate 7 is 1.58 mm; and the included angle between the push portion 1132 of the No. D password rebound leaf 14 and the horizontal plane is set to be 28°, so that the slide stroke of slide-down of the control plate 7 is 1.97 mm. The sequence of password setting of the No. A password rebound leaf 11, the No. B password rebound leaf 12, the No. C password rebound leaf 13 and the No. D password rebound leaf 14 is selected according to different angles between the push portions 1132 and the horizontal plane. The password rebound leaf with previous password setting generally has large angle, and the password rebound leaf with posterior password setting generally has small angle. The push portion 1132 and the limit point 1133 of the No. D password rebound leaf 14 form a plane structure. As the size of the reset plane 1131 of the No. D password rebound leaf 14 is set to be large, the No. D password rebound leaf 14 is generally a password rebound leaf with posterior password setting. But the push reset portion 113 of the No. 0 password rebound leaf 15 only includes the reset plane 1131 as the slide stroke of slide-down of the control plate 7 is 0 due to the No. 0 password rebound leaf 15.

The No. A password rebound leaf 11, the No. B password rebound leaf 12, the No. C password rebound leaf 13 or the No. D password rebound leaf 14 is provided with 1 to 4 positioning blocks 8. When the number of the positioning blocks 8 is more than two, the positioning blocks 8 are alternately arranged. The frequency of repeated password setting is determined by the number of the positioning blocks 8. When the number of the positioning block 8 is one, the frequency of repeated password setting is one. When the number of the positioning blocks 8 is two, the frequency of repeated password setting is two. In the embodiment, a positioning block 8 is disposed on the push portion 1132 of the No. A password rebound leaf 11, so that the No. A password rebound leaf 11 can achieve repeated password setting for one time.

Preferably, the label panel 2 includes a panel body 21, an axis hole 22 disposed in the center of the panel body 21, a plurality of first password rebound leaf relief grooves 23 uniformly distributed on the panel body 21, and an edge groove 24 disposed at the edge of the panel body 21; a shaft housing 25 is mounted in the axis hole 22; the axis panel 6 is connected with an axis 9; and the axis 9 runs through the fastener reset plate 5, the positioning plate 4 and the fastener locking plate 3 in sequence and is matched and connected with the shaft housing 25. Under the action of the password rebound leaf 1, the axis panel 6 is driven to move horizontally along the track of the axis 9.

Preferably, the fastener locking plate 3 includes a fastener locking plate body 31, first stop grooves 32 disposed at the edge of both sides of the fastener locking plate 31 respectively, a return spring gear piece 33 disposed on the fastener locking plate body 31, a bottom plate limit piece 34 and first panel limit pieces 35 disposed on the top of the fastener locking plate body 31 respectively, password exchange buttons 36 disposed at the bottom of the fastener locking plate body 31, an axis relief hole 37 disposed in the center of the fastener locking plate body 31, and password rebound leaf spring relief holes 38 distributed on both sides of the axis relief hole 37. The upper edge of the first stop groove 32 is matched with the first groove 1121 of the password rebound leaf 1. When the password rebound leaf 1 is pressed for deciphering, the password rebound leaf 1 is clamped on the upper edge of the first stop groove 32 and moves within the width range of the first groove 1121.

Preferably, the positioning plate 4 includes a positioning plate body 41, second panel limit pieces 42 integrally connected with the positioning plate body 41, a shaft housing rivet hole 43 disposed in the center of the positioning plate body 41, guide post relief holes 44 disposed on both sides of the shaft housing rivet hole 43, and second password rebound leaf relief grooves 45 distributed on the positioning plate body 41; the second panel limit piece 42 is provided with a fastener locking plate stroke groove 421; the fastener reset plate 5 includes a fastener reset plate body 51, second stop grooves 52 disposed at the edge of both sides of the fastener reset plate body 51 respectively, a reset piece 53 disposed at the bottom of the fastener reset plate body 51, a driving stroke relief hole 54 disposed in the center of the fastener reset plate body 51, and stop piece stroke holes 55 distributed on both sides of the driving stroke relief hole 54; the positioning plate 4 is connected with bottom plate tension spring screws 46; and the fastener reset plate 5 is connected with a stop piece tension spring screw 56 which is connected with the bottom plate tension spring screws 46 through a tension spring 10. When the password rebound leaf 1 is pressed for unlocking, along with the push of the password rebound leaf 1, the upper edge of the second stop groove 52 will be clamped with the second groove 1122; and subsequently, after the reset piece 53 is pushed up, the originally pushed and clamped password rebound leaf 1 will be immediately reset.

Preferably, the axis panel 6 includes an axis panel body 61, axis panel tension spring fixing portions 62 disposed on both sides of the top of the axis panel body 61, an axis panel adjusting device 63 disposed between the axis panel tension spring fixing portions 62, guide post holes 64 disposed in the center of the axis panel body 61, a plurality of axis panel drive grooves 65 distributed on both sides of the guide post holes 64, and a control plate limit stand 66 disposed on the axis panel body 61; the axis panel tension spring fixing portion 62 is provided with a tension spring fixing groove 621; the axis panel adjusting device 63 includes an adjusting fixing plate 631, a screw hole (not shown in the figure) disposed on the adjusting fixing plate 631, and an adjusting nut 632 mounted in the screw hole; the adjusting nut 632 may be configured to adjust the height of the control plate 7, so that the control plate 7 can slide at an appropriate position of the axis panel 6; the control plate limit stands 66 include strip control plate limit stands 661 disposed on both sides of the guide post holes 64 and a "U"-shaped control plate limit stand 662 disposed at the edge of the axis panel body 61; and guide rods 641 are mounted in guide post holes 64 and have guiding function.

Preferably, the control plate 7 includes a control plate body 71, control plate stroke grooves 72 and control plate tension spring grooves 73 disposed on both sides of the control plate body 71, a control plate bolt 74 disposed at the bottom of the control plate body 71, password rebound leaf stroke grooves 75 disposed in the center of the control plate body 71, and control plate stroke rivet holes 76 disposed on both sides of the password rebound leaf stroke grooves 75; and the control plate tension spring grooves 73 are connected with the tension spring fixing grooves 621 through control plate tension springs 77, so that the automatic return of the control plate 7 can be achieved.

The lock cylinder provided by the present invention further comprises a stop piece return spring 81 and a driving spring 82. The stop piece return spring 81 is sleeved on a riveting column 83 which is configured to fixedly connect the label panel 2 and the positioning plate 4; one end of the stop piece return spring 81 leans against the return spring gear piece 33; and the other end of the stop piece return spring 81 leans against the second panel limit piece 42. The driving spring 82 is sleeved on the axis 9; one end of the driving spring 82 leans against the label panel 2; and the other end of the driving spring 82 leans against the positioning plate 4.

In the case of password setting, the password exchange button 36 of the fastener locking plate 3 and the reset piece 53 of the fastener reset plate 5 are pressed at the same time; the No. A password rebound leaf 11, the No. B password rebound leaf 12, the No. C password rebound leaf 13, the No. D password rebound leaf 14 and the No. 0 password rebound leaves 15 are inserted into corresponding positions successively according to the default password of the user; if repeated password setting is required, a password rebound leaf 1 provided with a positioning block 8 is selected; after corresponding password rebound leaf 1 is inserted, the password exchange button 36 of the fastener locking plate 3 and the reset piece 53 of the fastener reset plate 5 are released; and at this point, password setting is completed.

Figure 14:
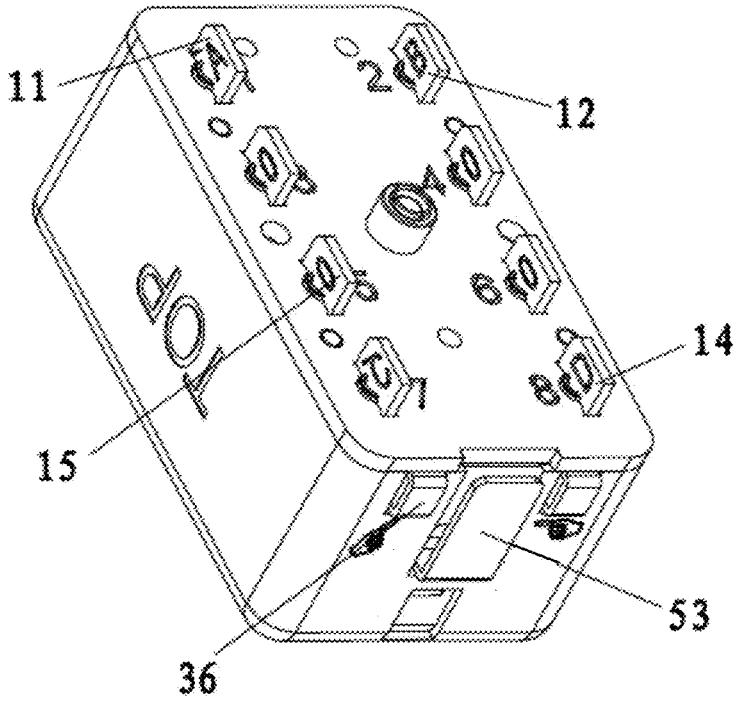
FIG. 14 is a schematic diagram 1 illustrating the password setting of the lock cylinder provided by the present invention (the original password state)
Figure 15:
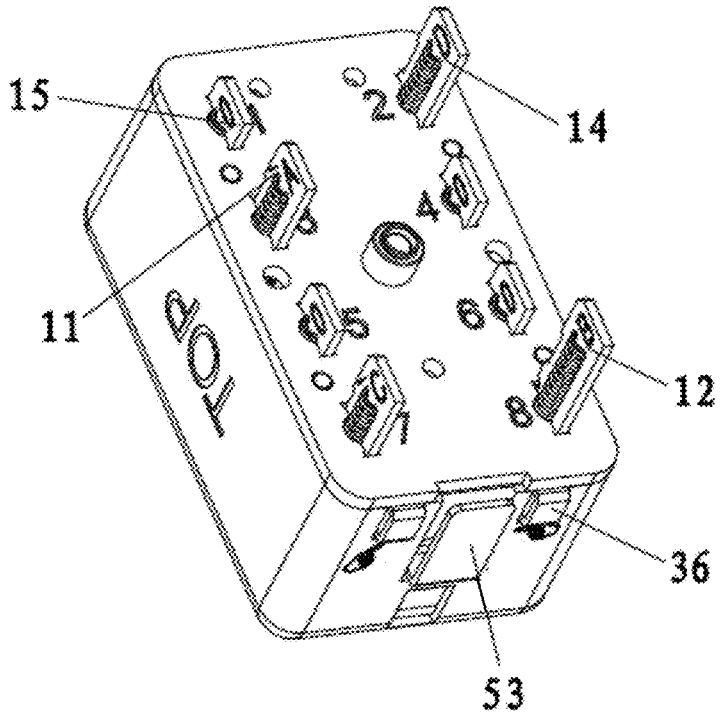
FIG. 15 is a schematic diagram 2 illustrating the password setting of the lock cylinder provided by the present invention (the new password setting state)

As illustrated in FIGS. 14 and 15, the specific steps of password setting are as follows: 1) setting the original password to be 1278 (as shown by labels on the label panel 2), and pressing the password exchange button 36 and the reset piece 53 at the same time; 2) setting the current password to be 3827, removing and exchanging the No. A password rebound leaf 11 at a position 1 and the No. 0 password rebound leaf 15 at a position 3, and setting a first password to be 3; removing and exchanging the No. B password rebound leaf 12 at a position 2 and the No. D password rebound leaf 14 at a position 8, and setting a second password to be 8; continuously operating like this and setting a third password and a fourth password (when repeated password setting is required, the user only needs to arrange the positioning block on the No. A password rebound leaf, the No. B password rebound leaf, the No. C password rebound leaf or the No. D password rebound leaf, and which password rebound leaf is selected may be determined by the user), so that the set password is 3827; and finally, releasing the password exchange button 36 and the reset piece 53, and completing the process of password setting.

In the lock cylinder provided by the present invention, various keys, e.g., the numbers from 1 to 9 or the English alphabets from A to Z, can be selected according to different key needs; different geometrical shapes can be arranged; the size is small; and the number of password combinations is large. The lock cylinder provided by the present invention can be conveniently used on various doors including door locks, safe locks, cabinet locks, car locks and the like, and can be very conveniently used.

Figure 16:
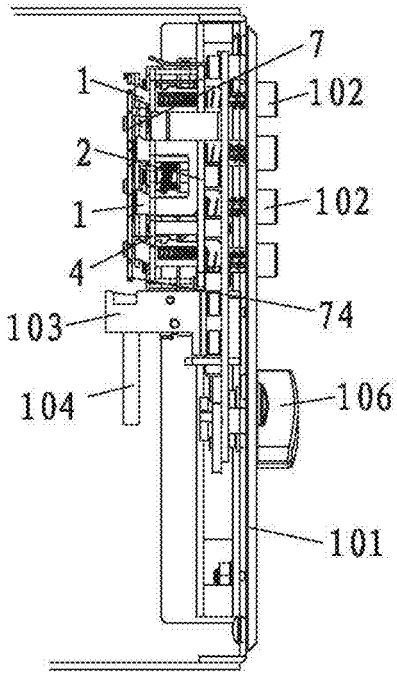
FIG. 16 is a schematic diagram 1 illustrating the state when the lock cylinder provided by the present invention is not unlocked from a lock panel.
Figure 17:
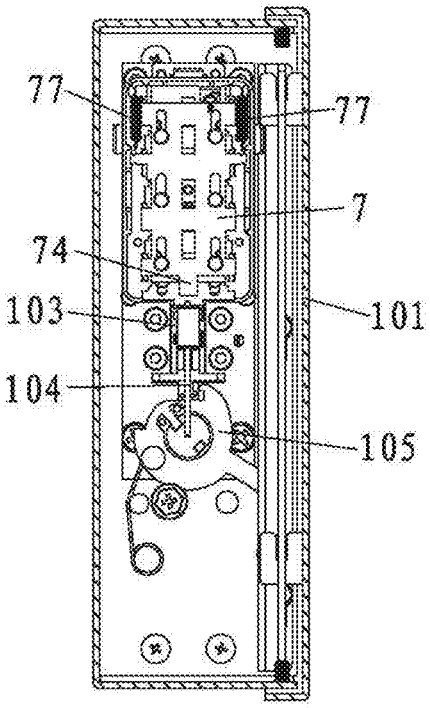
FIG. 17 is a schematic diagram 2 illustrating the state when the lock cylinder provided by the present invention is not unlocked from a lock panel.
Figure 18:
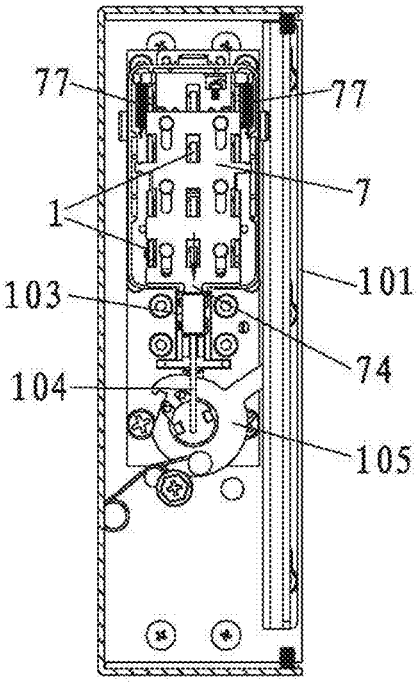
FIG. 18 is a schematic diagram illustrating the state when the lock cylinder provided by the present invention is unlocked from the lock panel.

As illustrated in FIGS. 16 to 18, the work of unlocking by utilization of the lock cylinder provided by the present invention is as follows: a key 102 on a lock panel 101 is operated according to the default password (each key 102 corresponds to a password rebound leaf 1), so that the password rebound leaf 1 disposed under the key 102 is driven to slide horizontally between the label panel 2 and the positioning plate 4 and hence clamp the control plate 7 to slide down; subsequently, the default password is pressed in sequence, so that the password rebound leaves 1 make contact with the control plate 7 one by one; finally, the control plate bolt 74 slides down step by step (if the default password is not pressed in sequence, the control plate 7 is restored to the original position under the action of the control plate tension spring 77 as the control plate 7 is not restricted by force); a lock rod body 103 on the lock panel 101 is pushed and an upper lever 104 of the lock rod body 103 is inserted into and matched with the locking plate 105; at this point, a knob 106 connected with the locking plate 105 is rotated; and hence unlocking can be achieved.

The name and the label of the components in the text and the original application document will be described below: the outer shell 91 in the text corresponds to the outer shell 1 in the original text; the positioning plate 4 in the text corresponds to the positioning plate 3 in the original text; the fastener reset plate 5 in the text corresponds to the buckle button reset plate 5 in the original text; the axis 9 in the text corresponds to the axis 6 in the original text; the axis panel 6 in the text corresponds to the axis panel 7 in the original text; the control plate 7 in the text corresponds to the control plate 8 in the original text; the password rebound leaves 1 in the text corresponds to the password rebound leaves 9 in the original text; the control plate tension spring 77 in the text corresponds to the control plate balance reset device 11 in the original text; the adjusting nut 632 in the text corresponds to the control plate height positioning device 12 in the original text; the fastener locking plate 3 in the text corresponds to the fastener locking plate 18 in the original text; the first groove 1121 in the text corresponds to the second groove 17 in the original text; and the second groove 1122 in the text corresponds to the first groove 16 in the original text.

What is claimed is:

1. An environment friendly metal mechanical password lock cylinder capable of setting repeatedly password keys, comprising:

a plurality of password rebound leaves including a No. A, a No. B, a No. C, a No. D, and No. 0 password rebound leaves, wherein each of the No. A, the No. B, the No. C, the No. D, and the No. 0 password rebound leaves includes:

a password rebound leaf body, at least a first groove, second, and third grooves disposed on a top of a respective password rebound leaf body in sequence, a push reset portion disposed on a side portion of the respective password rebound leaf body and including a reset plane, a push portion and a limit point which are connected with each other in sequence, a "Z"-shaped button spring access hole disposed in a center of the respective password rebound leaf body, and a button spring mounted in the "Z"-shaped button spring access hole, wherein an included angle between a horizontal plane and the push portions of the No. A, the No. B, the No. C, and the No. D password rebound leaves is 20 to 70 degrees, the push portion and the limit point of the No. D password rebound leaf form a plane structure, and the push reset portion of the No. 0 password rebound leaf only includes a reset plane, a label panel, a fastener locking plate, a positioning plate fixedly connected with the label panel and with the fastener locking plate disposed therebetween, a fastener reset plate slideably disposed on the positioning plate, an axis panel matched and connected with the label panel, and a control plate slideably disposed on the axis panel; wherein the password rebound leaves run through the label panel and the positioning plate in sequence and corresponds to the control plate and at least one password rebound leaf in the plurality of password rebound leaves is provided with one or more positioning blocks matched with the control plate.

2. The environment friendly metal mechanical password lock cylinder capable of setting repeatedly the password keys according to claim 1, wherein the No. A password rebound leaf, the No. B password rebound leaf, the No. C password rebound leaf or the No. D password rebound leaf is provided with one to four positioning blocks; and when the number of the positioning blocks is more than two, the positioning blocks are alternately arranged.

3. The environment friendly metal mechanical password lock cylinder capable of setting repeatedly the password keys according to claim 1, wherein the label panel includes a panel body, an axis hole disposed in the center of the panel body, a plurality of first password rebound leaf relief grooves uniformly distributed on the panel body, and an edge groove disposed at the edge of the panel body; a shaft housing is mounted in the axis hole; the axis panel is connected with an axis; and the axis runs through the fastener reset plate, the positioning plate and the fastener locking plate in sequence and is matched and connected with the shaft housing.

4. The environment friendly metal mechanical password lock cylinder capable of setting repeatedly the password keys according to claim 1, wherein the fastener locking plate includes a fastener locking plate body, first stop grooves disposed at the edge of both sides of the fastener locking plate respectively, a return spring gear piece disposed on the fastener locking plate body, a bottom plate limit piece and first panel limit pieces disposed on the top of the fastener locking plate body respectively, password exchange buttons disposed at the bottom of the fastener locking plate body, an axis relief hole disposed in the center of the fastener locking plate body, and password rebound leaf spring relief holes distributed on both sides of the axis relief hole.

5. The environment friendly metal mechanical password lock cylinder capable of setting repeatedly the password keys according to claim 4, wherein the positioning plate includes a positioning plate body, second panel limit pieces integrally connected with the positioning plate body, a shaft housing rivet hole disposed in the center of the positioning plate body, guide post relief holes disposed on both sides of the shaft housing rivet hole, and second password rebound leaf relief grooves distributed on the positioning plate body; the second panel limit piece is provided with a fastener locking plate stroke groove;

the fastener reset plate includes a fastener reset plate body, second stop grooves disposed at the edge of both sides of the fastener reset plate body respectively, a reset piece disposed at the bottom of the fastener reset plate body, a driving stroke relief hole disposed in the center of the fastener reset plate body, and stop piece stroke holes distributed on both sides of the driving stroke relief hole;

the positioning plate is connected with bottom plate tension spring screws; and the fastener reset plate is connected with a stop piece tension spring screw which is connected with the bottom plate tension spring screw through a tension spring.

6. The environment friendly metal mechanical password lock cylinder capable of setting repeatedly the password keys according to claim 1, wherein the axis panel includes an axis panel body, axis panel tension spring fixing portions disposed on both sides of the top of the axis panel body, an axis panel adjusting device disposed between the axis panel tension spring fixing portions, guide post holes disposed in the center of the axis panel body, a plurality of axis panel drive grooves distributed on both sides of the guide post holes, and a control plate limit stand disposed on the axis panel body;

the axis panel tension spring fixing portion is provided with a tension spring fixing groove; the axis panel adjusting device includes an adjusting fixing plate, a screw hole disposed on the adjusting fixing plate, and an adjusting nut mounted in the screw hole; the control plate limit stands include strip control plate limit stands disposed on both sides of the guide post holes and a "U"-shaped control plate limit stand disposed at the edge of the axis panel body; and guide rods are mounted in the guide post holes.

7. The environment friendly metal mechanical password lock cylinder capable of setting repeatedly the password keys according to claim 6, wherein the control plate includes a control plate body, control plate stroke grooves and control plate tension spring grooves disposed on both sides of the control plate body, a control plate bolt disposed at the bottom of the control plate body, password rebound leaf stroke grooves disposed in the center of the control plate body, and control plate stroke rivet holes disposed on both sides of the password rebound leaf stroke grooves; and the control plate tension spring grooves are connected with the tension spring fixing grooves through control plate tension springs.

8. The environment friendly metal mechanical password lock cylinder capable of setting repeatedly the password keys according to claim 5, further comprising a stop piece return spring, wherein the stop piece return spring is sleeved on a riveting column which is configured to fixedly connect the label panel and the positioning plate; one end of the stop piece return spring leans against the return spring gear piece; and the other end of the stop piece return spring leans against the second panel limit piece.

9. The environment friendly metal mechanical password lock cylinder capable of setting repeatedly the password keys according to claim 3, further comprising a driving spring, wherein the driving spring is sleeved on the axis; one end of the driving spring leans against the label panel; and the other end of the driving spring leans against the positioning plate.

* * * * *